US009607818B2

(12) United States Patent
Shiea

(10) Patent No.: US 9,607,818 B2
(45) Date of Patent: Mar. 28, 2017

(54) MULTIMODE IONIZATION DEVICE

(71) Applicant: National Sun Yat-Sen University, Kaohsiung (TW)

(72) Inventor: Jentaie Shiea, Kaohsiung (TW)

(73) Assignee: National Sun Yat-Sen University, Kaohsiung (TW)

( * ) Notice: Subject to any disclaimer, the term of this patent is extended or adjusted under 35 U.S.C. 154(b) by 0 days.

(21) Appl. No.: 14/252,257

(22) Filed: Apr. 14, 2014

(65) Prior Publication Data

US 2014/0312244 A1 Oct. 23, 2014

(30) Foreign Application Priority Data

Apr. 18, 2013 (TW) ..... 102113772 A

(51) Int. Cl.
*H01J 49/10* (2006.01)
*H01J 49/16* (2006.01)

(52) U.S. Cl.
CPC ..... *H01J 49/107* (2013.01); *H01J 49/165* (2013.01); *H01J 49/168* (2013.01)

(58) Field of Classification Search
CPC ..... H01J 49/107; H01J 49/165; H01J 49/168; H01J 49/145; H01J 49/14
USPC ..... 250/423 R, 424, 425, 288
See application file for complete search history.

(56) References Cited

U.S. PATENT DOCUMENTS 6,541,768 B2 * 4/2003 Andrien, Jr. ..... H01J 49/0009 250/288
6,831,271 B1 * 12/2004 Guevremont ..... B01D 59/46 250/281
7,078,681 B2 * 7/2006 Fischer ..... H01J 49/0445 250/288
7,294,841 B2 * 11/2007 Bajic ..... H01J 49/044 250/423 R
7,399,961 B2 * 7/2008 Chen ..... G01N 30/7266 250/281

(Continued)

FOREIGN PATENT DOCUMENTS

JP 08-297112 A 11/1996
JP 2005-116460 A 4/2005
WO WO-2009/157312 A1 12/2009

OTHER PUBLICATIONS

Hirabayashi, Atsuma; et al., Sonic Spray Ionization Method for Atmospheric Pressure Ionization Mass Spectrometry, Anal. Chem. 1994, 66, 4557-4559.*

(Continued)

*Primary Examiner* — Wyatt Stoffa
(74) *Attorney, Agent, or Firm* — Foley & Lardner LLP

(57) ABSTRACT

A multimode ionization device includes an electrospray unit, a charge generating unit, and a plasma supplying unit. The electrospray unit is configured to form an electrospray plume which travels along a traveling path. The charge generating unit is configured to permit a liquid electrospray medium to leave the electrospray unit as the electrospray plume. The plasma supplying unit can generate and guide a plasma plume to mix with the electrospray plume so as to obtain a plume combination in a confluent zone, and is oriented to permit at least one of analytes carried in the plume combination to travel to the receiving unit along a linearly-extending end zone of the traveling path.

1 Claim, 12 Drawing Sheets

(56) References Cited

U.S. PATENT DOCUMENTS 7,473,893 B2 * 1/2009 Lopez-Avila ..... H01J 49/107 204/452
7,525,086 B2 * 4/2009 Suzuki ..... H01J 49/165 250/288
7,679,053 B2 * 3/2010 Schneider ..... H01J 49/0009 250/281
7,750,291 B2 * 7/2010 Shiea ..... H01J 49/0431 250/281
8,253,098 B2 * 8/2012 Hiraoka ..... H01J 49/165 250/288
8,450,682 B2 * 5/2013 Hiraoka ..... H01J 49/165 250/288
8,519,354 B2 * 8/2013 Charipar ..... H01J 49/105 250/282
8,853,626 B2 * 10/2014 Hiraoka ..... H05H 1/30 250/281
2006/0054805 A1 * 3/2006 Flanagan ..... H01J 49/107 250/288
2006/0255261 A1 * 11/2006 Whitehouse ..... H01J 49/0431 250/288
2007/0023675 A1 * 2/2007 Fischer ..... H01J 49/0445 250/423 P
2007/0164209 A1 * 7/2007 Balogh ..... H01J 49/145 250/288
2008/0073502 A1 * 3/2008 Schneider ..... H01J 49/0009 250/282
2009/0212206 A1 * 8/2009 Shiea ..... H01J 49/0431 250/282
2009/0236518 A1 * 9/2009 Kobayashi ..... G01N 30/726 250/288
2011/0006198 A1 * 1/2011 Whitehouse ..... H01J 49/165 250/282
2011/0031392 A1 * 2/2011 McEwen ..... H01J 49/0477 250/283
2011/0108726 A1 * 5/2011 Hiraoka ..... H01J 49/165 250/282
2011/0287554 A1 * 11/2011 Whitehouse ..... H01J 49/0027 436/173
2013/0193318 A1 * 8/2013 Land ..... H01J 49/10 250/282
2013/0341503 A1 * 12/2013 Whitehouse ..... H01J 49/045 250/287
2014/0011282 A1 * 1/2014 Ouyang ..... H01J 49/105 436/86
2014/0326871 A1 * 11/2014 Whitehouse ..... H01J 49/0431 250/288
2014/0353491 A1 * 12/2014 Hager ..... H01J 49/0031 250/282

OTHER PUBLICATIONS

Mass spectra chart, downloaded from https://www.ucl.ac.uk/eastman/research/departments/biomaterials-and-tissue-engineering/facilities/inductively-coupled-plasma-mass-spectrometry/icp1.png on Mar. 4, 2016.*

Office Action dated Mar. 24, 2015, received in corresponding Japanese application No. 2014-077526 (3 pages), and English translation of Japanese Office Action (3 pages).

* cited by examiner

MULTIMODE IONIZATION DEVICE

CROSS-REFERENCE TO RELATED PATENT APPLICATIONS

This application claims the benefit of the priority date of Taiwanese Application No. 102113772, filed on Apr. 18, 2013, the content of which is incorporated herein by reference in its entirety.

BACKGROUND OF THE INVENTION

1. Field of the Invention

This invention relates to a multimode ionization device, more particularly to a multimode ionization device adapted for use in a mass spectrometer.

2. Description of the Related Art

A mass spectrometer works by ionizing analytes to generate ionized analytes and measuring their mass-to-charge ratios. There are several approaches for ionizing analytes, and different approaches are suitable for ionization of different classes of analytes. For example, an electrospray ionization device is suitable for ionizing polar molecules (such as peptide, protein, etc.), but not for nonpolar molecules (such as saturated hydrocarbons, polycyclic aromatic hydrocarbons, etc.). An atmospheric pressure chemical ionization device is suitable for ionizing nonpolar molecules, but not polar molecules. Thus, when analyzing a sample including polar and nonpolar molecules, it is necessary to analyze the sample separately using different mass spectrometers with different ionization devices. As such, there is a need to provide a multimode ionization device for ionizing analytes of different properties.

Referring to FIG. 1, U.S. Pat. No. 7,078,681 discloses a multimode ionization source which includes an electrospray ionization source (ESI source) 5 and an atmospheric pressure chemical ionization source (APCI source) 6 that is disposed downstream of the ESI source 5. The ESI source 5 includes a nebulizer 51 and a drying device 52. A liquid medium 50 including analytes is introduced into the nebulizer 51, and is transported to an orifice 511 from which a charged aerosol is produced, moving to an ionization region 70. The drying device 52 has a sweep gas conduit 521 for providing a sweep gas to the charged aerosol at the ionization region 70. A first potential difference between a nebulizer tip 512 of the nebulizer 5 and a first electrode 53 creates an electric field for producing the charged aerosol at the nebulizer tip 512, while a second potential difference between a second electrode 54 and a conduit 8 creates an electric field for directing or guiding ions toward the conduit 8. The APCI source 6 includes a corona needle 61. A corona discharge is produced by a high electric field at the corona needle 61. The electric field is produced predominately by the potential difference between the corona needle 61 and the conduit 8. In this case, when the charged aerosol travels to the ionization region 70, it can be further ionized by virtue of the corona discharge.

SUMMARY OF THE INVENTION

Therefore, an object of the present invention is to provide a multimode ionization device which includes two ionization units for ionizing analytes at the same time and at the same location so as to permit polar and nonpolar analytes to be ionized more efficiently and more effectively.

According to the present invention, a multimode ionization device is adapted for use in a mass spectrometer which includes a receiving unit disposed to admit therein ionized analytes that are derived from a sample, and that are to be analyzed by the mass spectrometer. The multimode ionization device includes:

an electrospray unit including a reservoir for providing a liquid electrospray medium, and a nozzle which is disposed downstream of the reservoir and which is configured to form an electrospray plume of the liquid electrospray medium thereat, the nozzle being disposed to be spaced apart from the receiving unit so as to define a traveling path therebetween;

a charge generating unit configured to laden the liquid electrospray medium with a plurality of charges when the liquid electrospray medium running up to the nozzle so as to permit the liquid electrospray medium to leave the nozzle as the electrospray plume for heading toward the receiving unit to be admitted thereinto; and a plasma supplying unit configured to generate and guide a plasma plume to mix with the electrospray plume so as to form a plume combination in a confluent zone which is upstream of a linearly-extending end zone of the traveling path, and which is oriented to permit at least one of analytes carried in the plume combination to travel to the receiving unit along the linearly-extending end zone, such that as a result of approaching the receiving unit along the linearly-extending end zone, charges of the plume combination will pass on to said at least one of the analytes carried in the plume combination to thereby form a corresponding one of the ionized analytes.

BRIEF DESCRIPTION OF THE DRAWINGS

Other features and advantages of the present invention will become apparent in the following detailed description of the preferred embodiments of the invention, with reference to the accompanying drawings, in which:

FIG. 11(*b*) shows a spectrum of the first sample which is taken using the multimode ionization device of FIG. 9 with only the ESI source being operated;

FIG. 11(*c*) shows a spectrum of the first sample which is taken using the multimode ionization device of FIG. 9 with only the APCI-plasma source being operated;

FIG. 12(*b*) shows a spectrum of the second sample which is taken using the multimode ionization device of FIG. 9 with only the APCI-plasma source being operated; and FIG. 12(*c*) shows a spectrum of the second sample which is taken using the multimode ionization device of FIG. 9 with only the ESI source being operated.

DETAILED DESCRIPTION OF THE PREFERRED EMBODIMENTS

Figure 1:
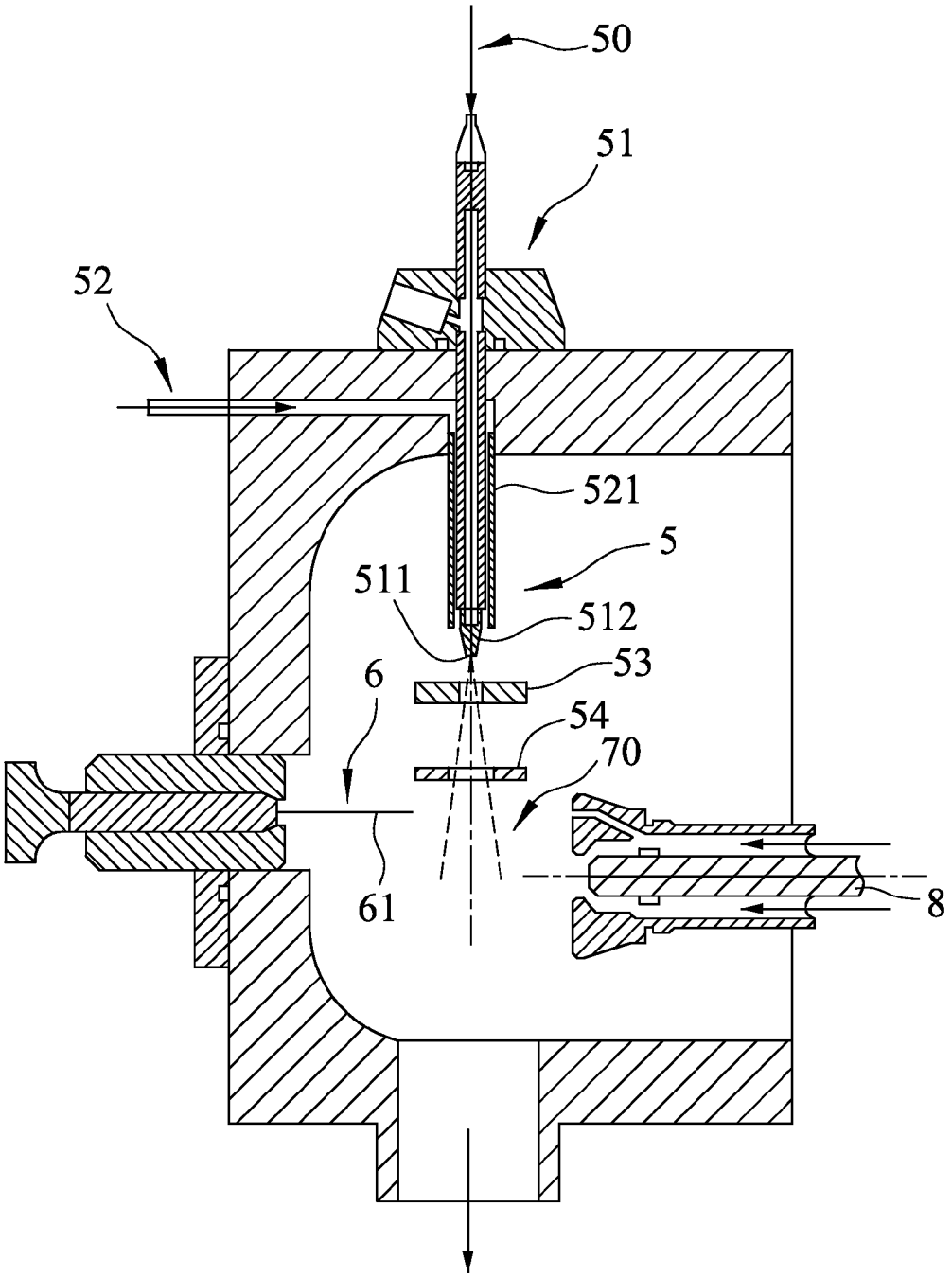
FIG.1 PRIOR ART
FIG. 1 is a cross-sectional view of a conventional multimode ionization source disclosed in U.S. Pat. No. 7,078,681.

Before the present invention is described in greater detail, it should be noted herein that same reference numerals are used to denote like elements throughout the specification.

Figure 2:
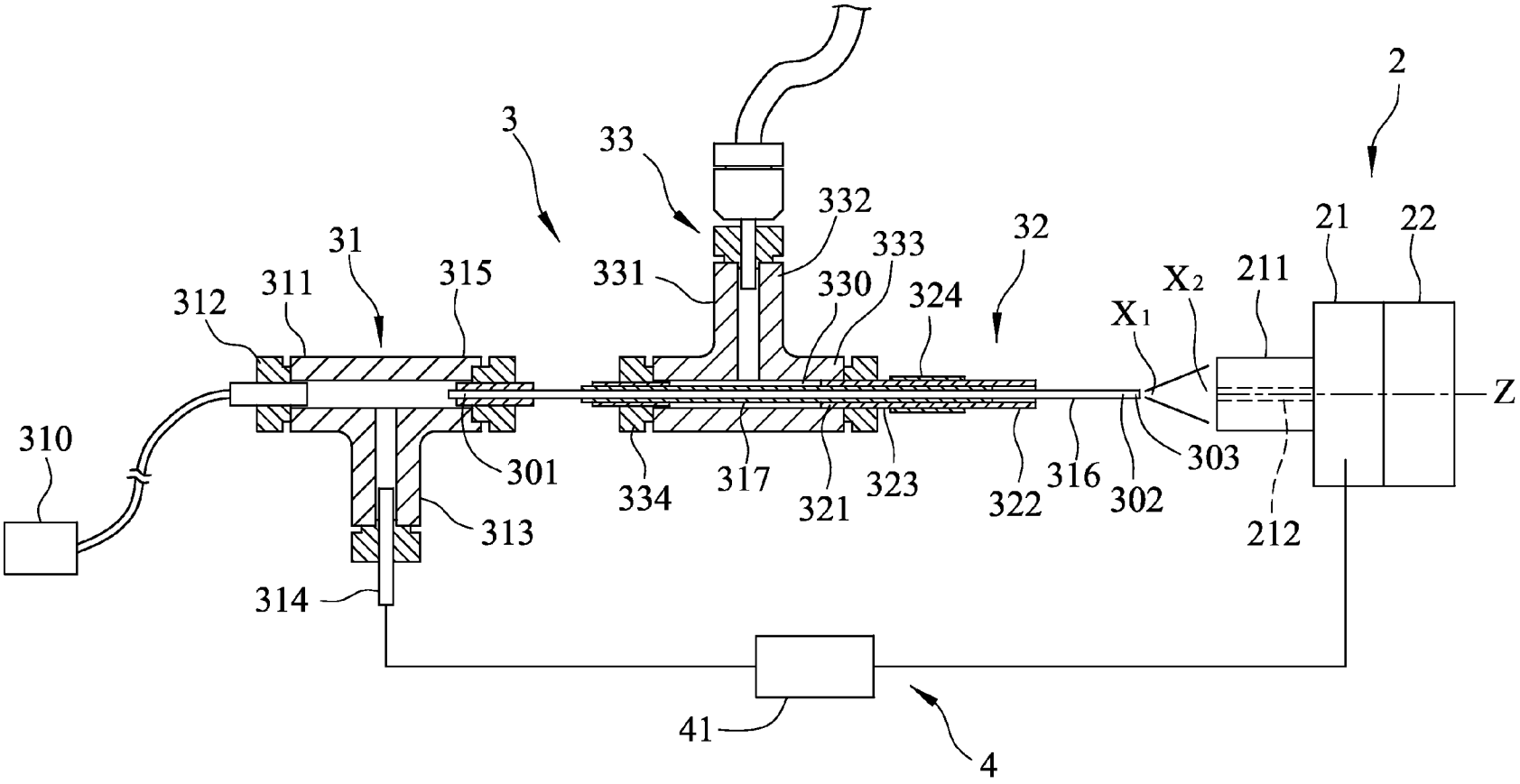
FIG. 2 is a fragmentary cross-sectional view of a multimode ionization device according to the first preferred embodiment of this invention.
Figure 3:
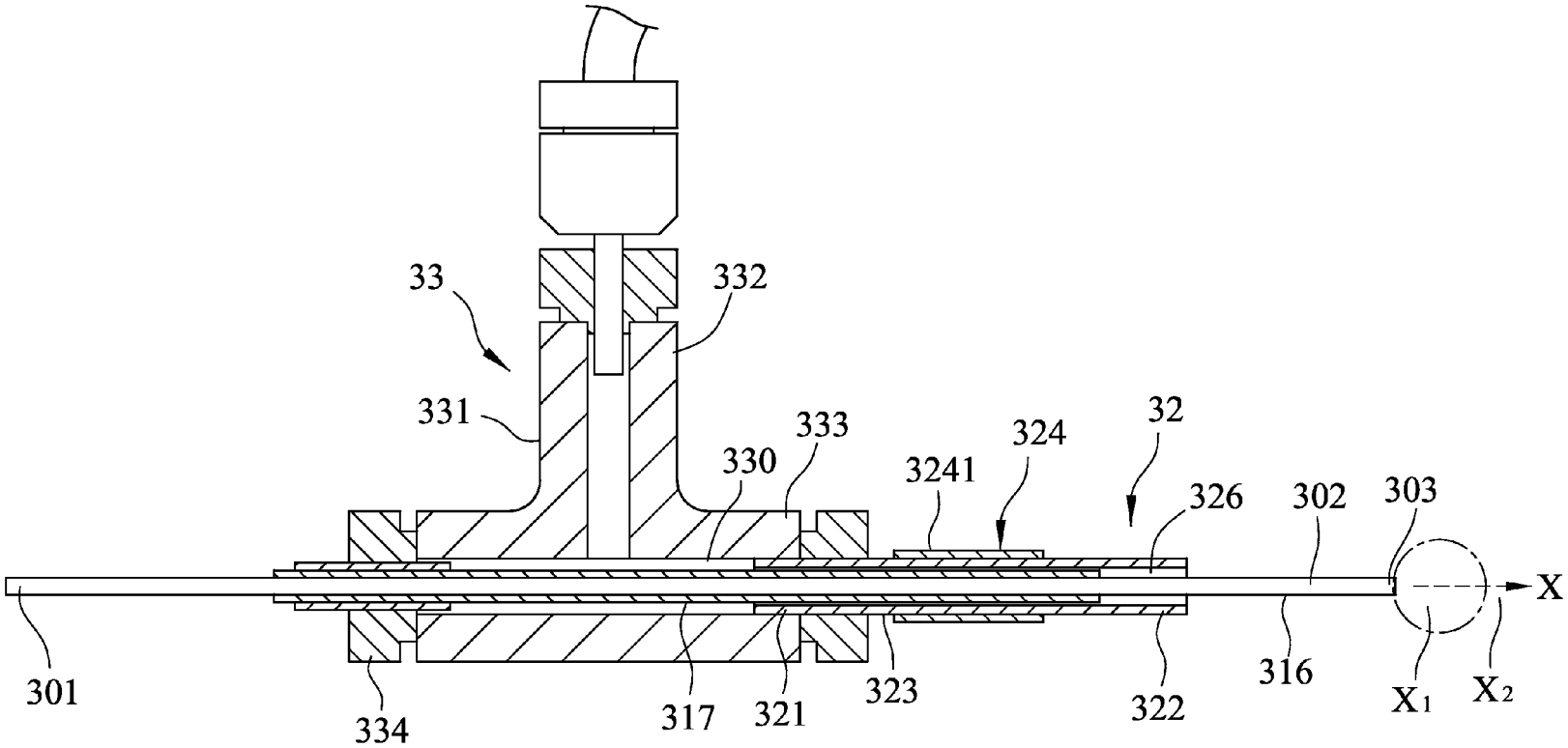
FIG. 3 is a fragmentary enlarged view of FIG. 2.

Referring to FIGS. 2 and 3, a multimode ionization device 3 according to the first preferred embodiment of this invention is adapted for use in a mass spectrometer 2.

The mass spectrometer 2 includes a receiving unit 21 and a detector 22. The receiving unit 21 is disposed to admit therein ionized analytes that are derived from a sample, and that are to be analyzed by the mass spectrometer 2. The receiving unit 21 includes a mass analyzer 211 for analyzing the ionized analytes. The mass analyzer 211 is formed with an entry port 212 for entrance of the ionized analytes. The detector 22 is disposed to receive signals generated as a result of analysis of the ionized analytes by the mass analyzer 21 so as to generate a mass spectrometric analysis result, i.e., a mass spectrum.

The multimode ionization device 3 includes an electrospray unit 31 which is of an electrospray ionization source (ESI source), a plasma supplying unit 32 which is of an atmospheric pressure chemical ionization source (APCI source), and a charge generating unit 4.

The electrospray unit 31 includes a reservoir 310 for providing a liquid electrospray medium, and a nozzle 303 which is disposed downstream of the reservoir 310 and which is configured for sequentially forming a plurality of electrospray plumes of the liquid electrospray medium thereat. The nozzle 303 is disposed to be spaced apart from the receiving unit 21 so as to define a traveling path (X) therebetween.

Preferably, the electrospray unit 31 further includes a guiding tube 316 extending lengthwise to terminate at first and second tube ends 301, 302 that are opposite to each other. The first tube end 301 is in fluid communication with the reservoir 310, and the second tube end 302 serves as the nozzle 303. In this embodiment, the guiding tube 316 is a capillary tube and is reinforced by a rigid tube 317.

The charge generating unit 4 is configured to laden the liquid electrospray medium with a plurality of charges when the liquid electrospray medium running up to the nozzle 303 so as to permit the liquid electrospray medium to leave the nozzle 303 as the electrospray plume for heading toward the receiving unit 21 to be admitted thereinto. In this preferred embodiment, the charge generating unit 4 includes a voltage supplying member 41 which is disposed to establish between the electrospray unit 31 and the receiving unit 21 a potential difference of an intensity to laden the liquid electrospray medium with a plurality of charges and to force the liquid electrospray medium to leave the nozzle 303 as the electrospray plumes.

The plasma supplying unit 32 is configured to sequentially generate a plurality of plasma plumes and to guide each plasma plume to mix with the electrospray plume so as to form a plume combination in a confluent zone (X1) which is upstream of a linearly-extending end zone (X2) of the traveling path (X), and which is oriented to permit at least one of analytes carried in the plume combination to travel to the receiving unit 21 along the linearly-extending end zone (X2), such that as a result of dwindling in size of the plume combination approaching the receiving unit 21 along the linearly-extending end zone (X2), charges of the plume combination will pass on to said at least one of the analytes carried in the plume combination to thereby form a corresponding one of the ionized analytes.

Preferably, the plasma supplying unit 32 includes a guiding conduit 323 which extends lengthwise to terminate at first and second conduit ends 321, 322 that are opposite to each other. The first conduit end 321 is distal from the nozzle 303, and the second conduit end 322 is opposite to the first conduit end 321, and is proximate to the nozzle 303, such that each plasma plume generated from a plasma-forming gas is permitted to leave the guiding conduit 323 through the second conduit end 322 to thereby mix with the electrospray plume in the confluent zone (X1). The plasma-forming gas can be air, nitrogen gas, helium gas, etc., and an inert gas is preferred.

In this embodiment, the guiding conduit 323 is co-axial with and surrounds the guiding tube 316 to define an annular space 326 so as to permit the plasma-forming gas which is introduced thereinto through the first conduit end 321 to be guided therein for generation of the plasma plumes.

Preferably, the plasma supplying unit 32 further includes a plasma-generating member 324. The plasma-generating member 324 is disposed on an outer conduit surface of the guiding conduit 323 and between the first and second conduit ends 321, 322, and is configured to apply a high voltage to the plasma-forming gas so as to generate the plasma plumes. In this embodiment, the plasma-generating member 324 has an annular electrode 3241 which is sleeved on the guiding conduit 323, and the high voltage is applied to the annular electrode 3241 to ionize the plasma-forming gas passing through the annular space 326 so as to generate the plasma plumes.

Preferably, the multimode ionization device 3 further includes a pressurized gas supplying unit 33. The pressurized gas supplying unit 33 has an outlet 330 configured to be in fluid communication with the first conduit end 321 so as to permit the plasma-forming gas to be introduced into the annular space 326. In this embodiment, the pressurized gas supplying unit 33 includes a gas supplier (not shown) for supplying the pressurized plasma-forming gas, and a gas-guiding Tee-shaped pipe 331 which has three ports 332, 333, 334. The port 332 is in communication with the gas supplier for introduction of the pressurized plasma-forming gas into the gas-guiding Tee-shaped pipe 331 through the port 332. The port 333 has the outlet 330 and is in communication with the first conduit end 321. The port 334 is sealed to an outer surface of the rigid tube 317.

Moreover, the electrospray unit 31 further includes a liquid-guiding Tee-shaped pipe 311 which has three ports 312, 313, and 315. The port 312 is in communication with the reservoir 310 for permitting the liquid electrospray medium to flow into the Tee-shaped pipe 311 through the port 312. The port 315 is secured to the first tube end 301 for guiding the liquid electrospray medium to flow into the guiding tube 316. The port 313 is fitted with an electrode 314 which is disposed to be in contact with the liquid electrospray medium and which is electrically connected to the voltage supplying member 41. The voltage supplying member 41 is also electrically connected to the receiving unit 21. Thus, a potential difference can be established between the nozzle 303 of the electrospray unit 31 and the receiving unit 21 by virtue of the voltage supplying member 41.

In this embodiment, the analytes are dispersed in the liquid electrospray medium, and the traveling path (X) extends linearly. With further reference to FIGS. 2 and 3, during operation, electrospray plumes are sequentially generated, each of which is mixed with a plasma plume at the confluent zone (X1), thereby forming sequentially plume combinations each carrying at least one of the analytes. The plume combinations are sequentially forced toward the receiving unit 21 along the linearly-extending end zone (X2) of the traveling path (X) due to the potential difference between the nozzle 303 of the electrospray unit 31 and the receiving unit 21. When each plume combination approaches the receiving unit 21, it will dwindle in size and the charges thereof will pass onto said at least one of the analytes therein to thereby form an ionized analyte. The ionized analyte is analyzed by the mass analyzer 211 after entering the mass analyzer 211 through the entry port 212. Signals generated as a result of analysis of the ionized analytes by the mass analyzer 211 are received by the detector 22 for generating a mass spectrum based on the signals.

Figure 4:
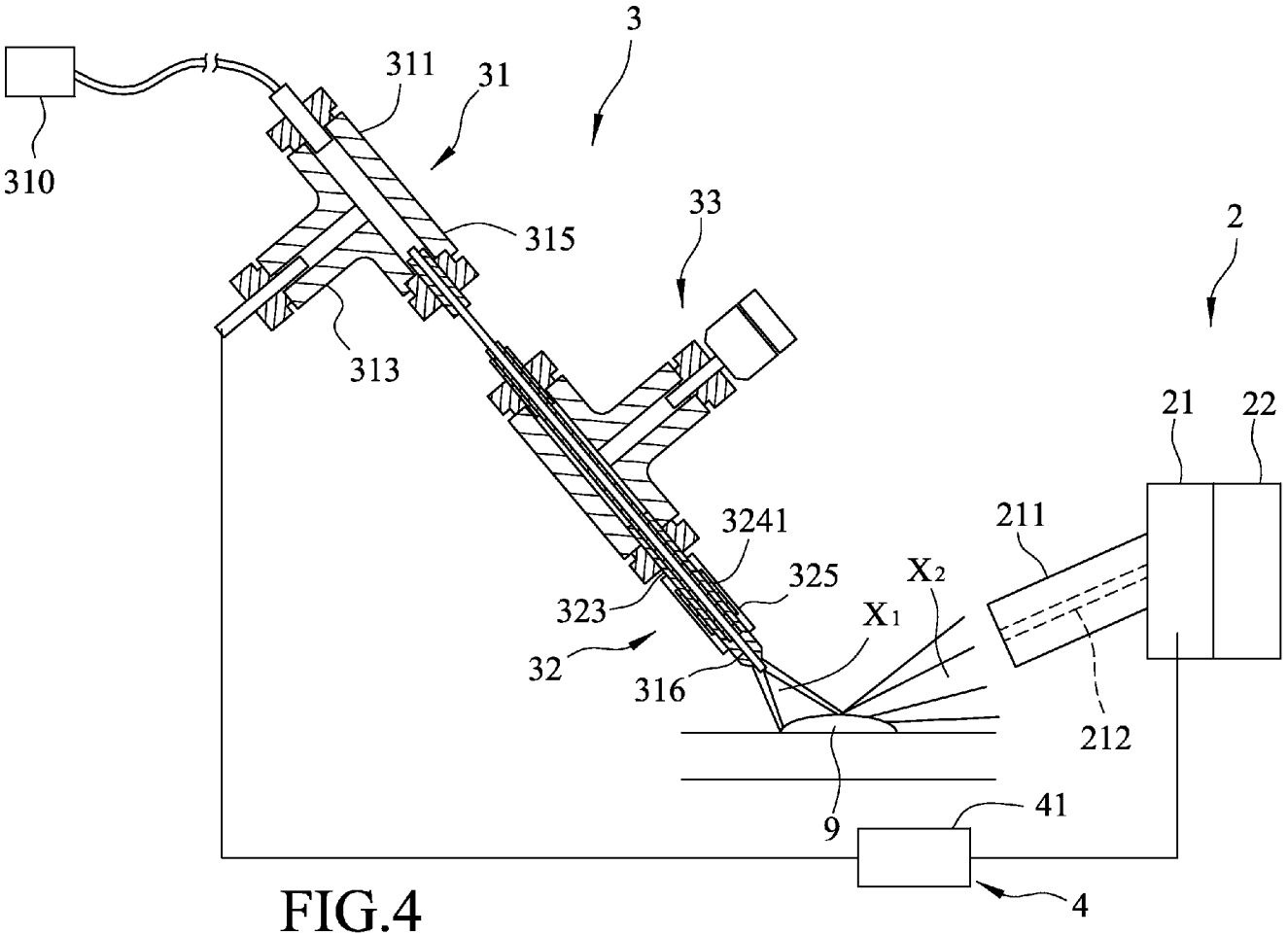
FIG. 4 is a fragmentary cross-sectional view of a multimode ionization device according to the second preferred embodiment of this invention.

FIG. 4 illustrates a multimode ionization device 3 according to the second preferred embodiment of this invention. The second preferred embodiment is similar to the first preferred embodiment except that the multimode ionization device 3 in the second preferred embodiment further includes a heating member 325 which is disposed around the guiding conduit 323 and the annular electrode 3241. In the embodiment, a sample 9 is disposed downstream of the confluent zone (X1) and upstream of the linearly-extending end zone (X2). Referring to FIG. 4, as the electrospray plumes are sequentially generated, each of them is mixed with and is directed by a heated plasma plume to form a plume combination which is directed to impinge upon the sample 9 such that at least one of analytes contained in the sample 9 is desorbed so as to be carried in the plume combination. Thereafter, the sequentially formed plume combinations are forced toward the receiving unit 21 along the linearly-extending end zone (X2) of the traveling path (X) due to the potential difference between the nozzle 303 of the electrospray unit 31 and the receiving unit 21.

Figure 5:
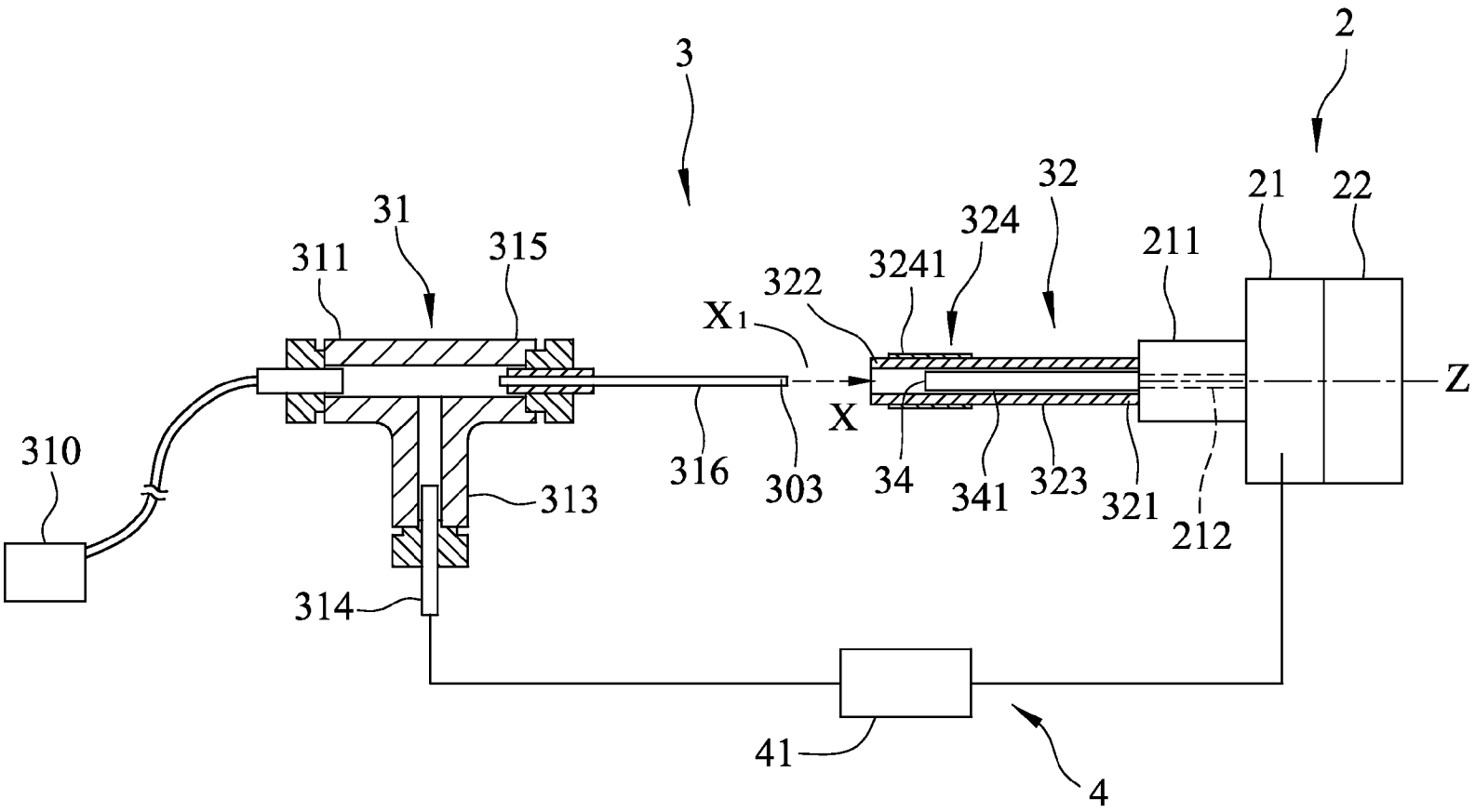
FIG. 5 is a fragmentary cross-sectional view of a multimode ionization device according to the third preferred embodiment of this invention.

FIG. 5 illustrates a multimode ionization device 3 according to the third preferred embodiment of this invention. The third preferred embodiment is similar to the first preferred embodiment except that the pressurized gas supplying unit 33 is omitted, and that the plasma supplying unit 32 is disposed adjacent to the mass analyzer 211 of the receiving unit 21.

In this embodiment, the entry port 212 defines an entry axis (Z), and the multimode ionization device 3 further includes a tubular extension 34 which is configured to be in fluid communication with the entry port 212, and which extends from the entry port 212 along the entry axis (Z) toward the confluent zone (X1). The guiding conduit 323 is disposed to surround the tubular extension 34 to define a surrounding space 341 so as to permit the plasma-forming gas which is introduced thereinto through the first conduit end 321 to be guided therein for sequential generation of the plasma plumes. In this embodiment, the plasma-forming gas is forced into the surrounding space 341 through the first conduit end 321 by virtue of a pressurized gas supplying unit (not shown). When the plasma-forming gas passes through the surrounding space 341 and through the annular electrode 3241, a high voltage is applied to the annular electrode 3241 to ionize the plasma-forming gas for generating the plasma plumes. The plasma plumes are directed to the confluent zone (X1) to mix with the electrospray plumes so as to obtain the plume combinations. The plume combinations are forced toward the receiving unit 21 along the linearly-extending end zone (X2) of the traveling path (X) due to the potential difference between the nozzle 303 of the electrospray unit 31 and the receiving unit 21.

Figure 6:
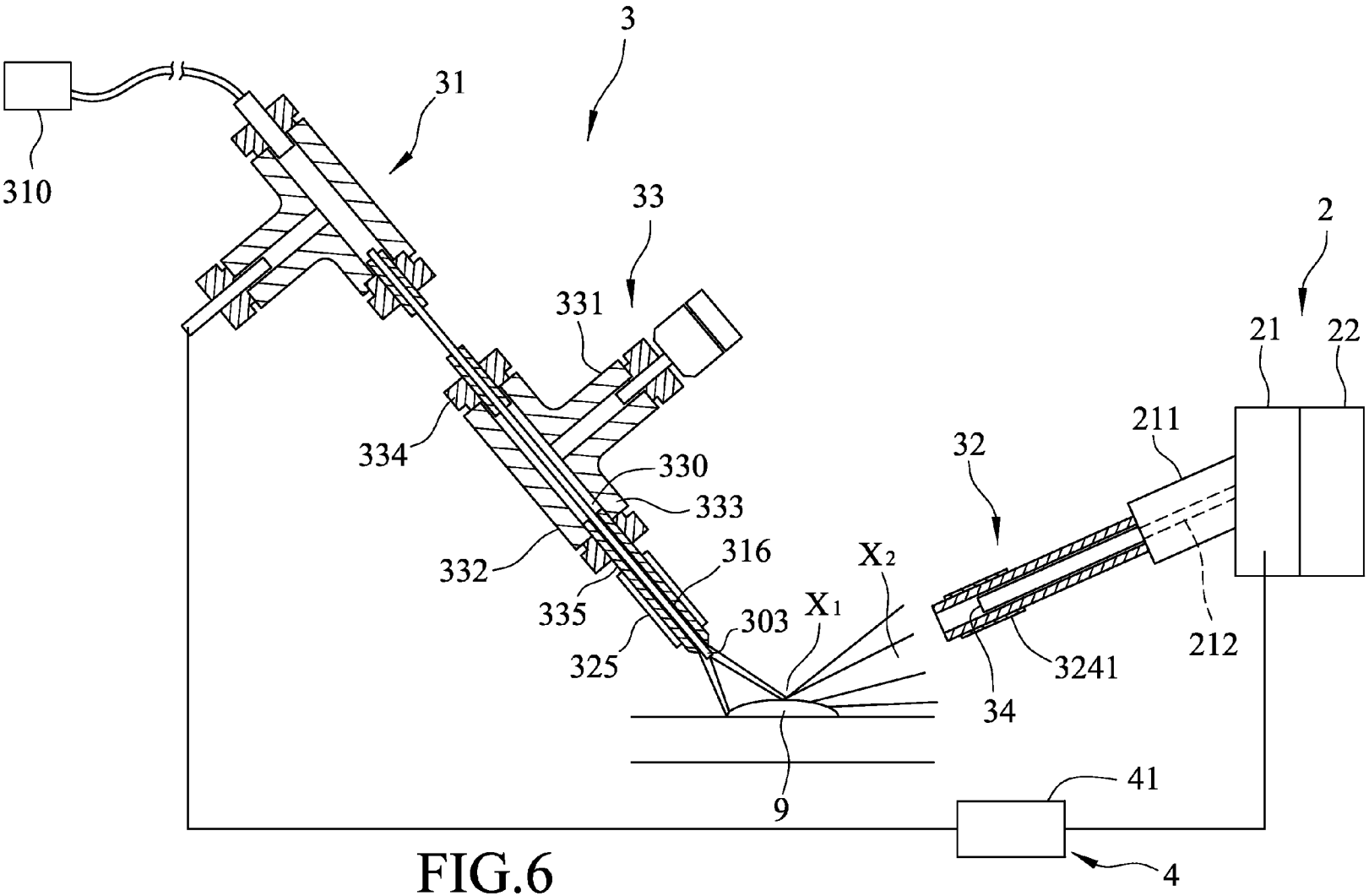
FIG. 6 is a fragmentary cross-sectional view of a multimode ionization device according to the fourth preferred embodiment of this invention.
Figure 7:
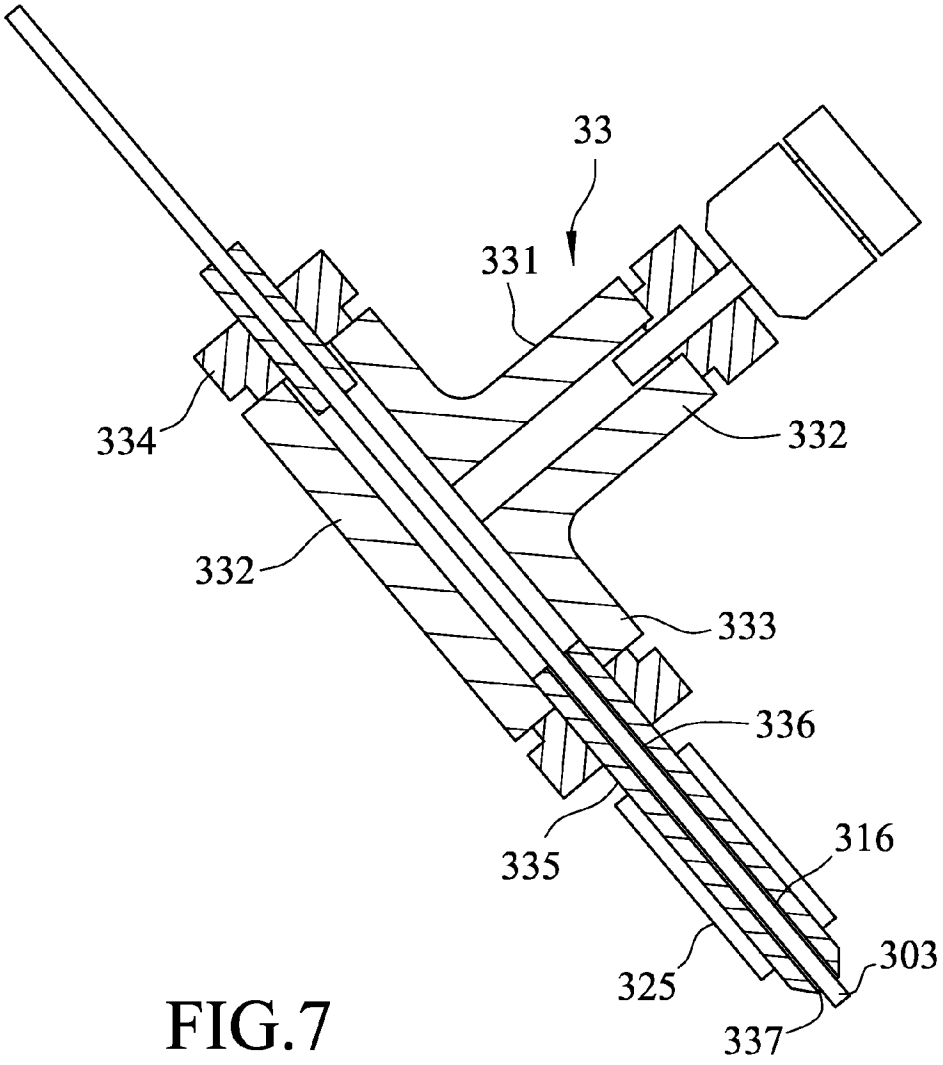
FIG. 7 is a fragmentary enlarged view of FIG. 6.

FIGS. 6 and 7 illustrate a multimode ionization device 3 according to the fourth preferred embodiment of this invention. The fourth preferred embodiment is similar to the third preferred embodiment except that the multimode ionization device 3 in the fourth preferred embodiment further includes a pressurized gas supplying unit 33 and a heating member 325.

In this embodiment, the pressurized gas supplying unit 33 includes a gas-guiding Tee-shaped pipe 331 which has three ports 332, 333, 334, and a guiding member 335 which has a tubular duct 336. The port 332 is in communication with a gas supplier (not shown) for introduction of a pressurized gas into the gas-guiding Tee-shaped pipe 331 through the port 332. The port 333 is in fluid communication with the guiding member 335. The port 334 is sealed to the guiding tube 316. The tubular duct 336 is configured to permit the guiding tube 316 to pass therethrough, and extends to terminate at a duct outlet 337 which is disposed immediately upstream of the nozzle 303 to permit the pressurized gas to be ejected through the duct outlet 337 so as to direct the electrospray plumes toward the confluent zone (X1) for impinging upon a sample 9 disposed at the confluent zone (X1) together with the plasma plumes at the confluent zone (X1). Thus, at least one of analytes contained in the sample 9 is desorbed so as to be carried in the plume combination formed in the confluent zone (X1). The sequentially formed plume combinations are forced toward the receiving unit 21 along the linearly-extending end zone (X2) of the traveling path (X) due to the potential difference between the nozzle 303 of the electrospray unit 31 and the receiving unit 21. The heating member 325 is disposed around the gas guiding member 335 to increase the temperature of the pressurized gas.

Figure 8:
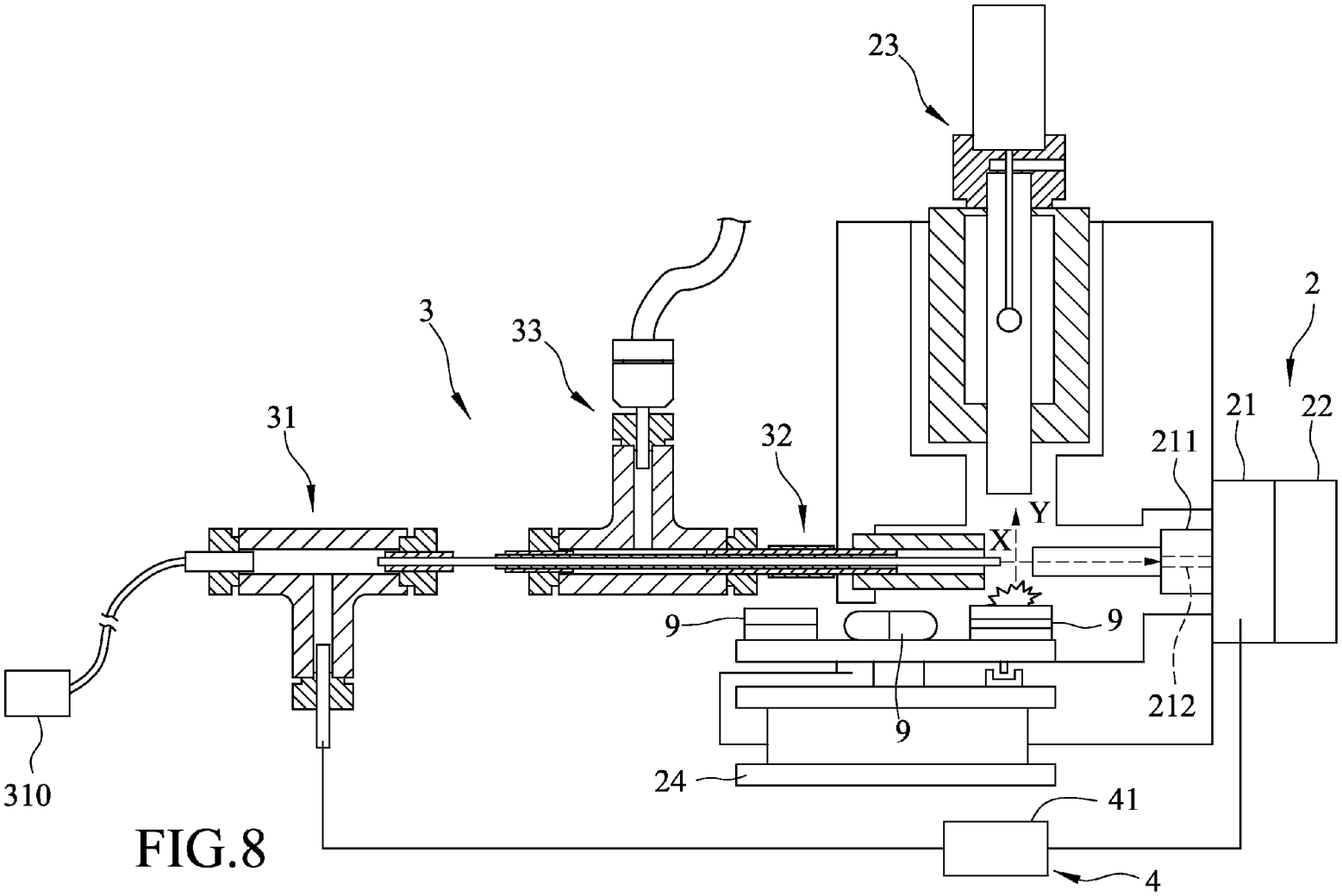
FIG. 8 is a fragmentary cross-sectional view of a multimode ionization device according to the fifth preferred embodiment of this invention.

FIG. 8 illustrates a multimode ionization device 3 according to the fifth preferred embodiment of this invention. The fifth preferred embodiment is similar to the first preferred embodiment except that the multimode ionization device 3 in the fifth preferred embodiment further includes a desorption unit 23 which is adapted to apply an energy to the sample 9 such that at least one of analytes contained in the sample 9 is desorbed to fly along a flying path (Y) that intersects the traveling path (X) so as to enable said at least one of the analytes to be carried in the plume combination.

The desorption unit 23 can be any known device capable of desorption of the analytes, such as a laser desorption device, a thermal desorption device, a laser induced acoustic desorption device, etc.

In this embodiment, different samples 9 can be mounted on a rotatable platform 24 for sequential ionization and analysis.

Figure 9:
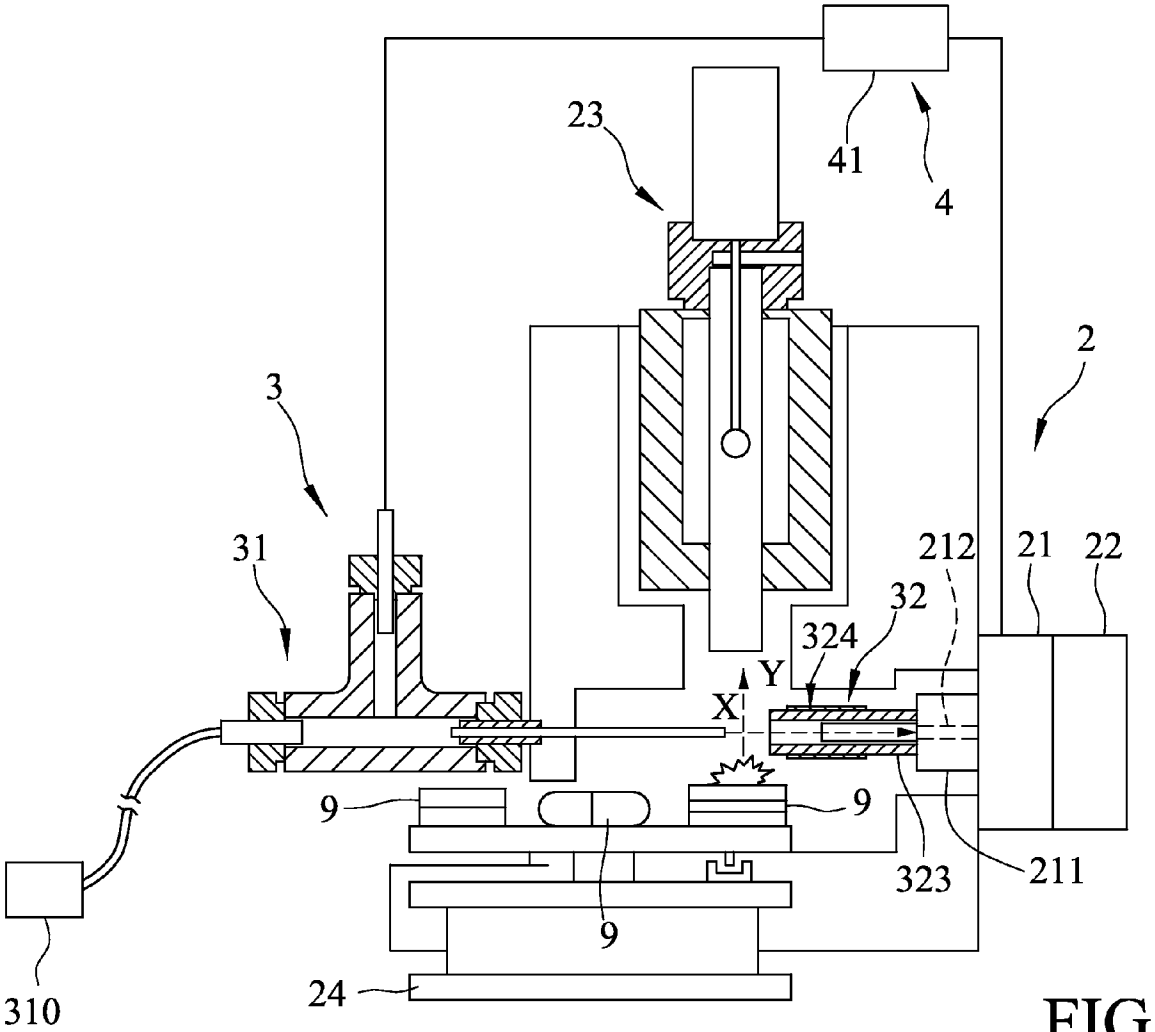
FIG. 9 is a fragmentary cross-sectional view of a multimode ionization device according to the sixth preferred embodiment of this invention.

FIG. 9 illustrates a multimode ionization device 3 according to the sixth preferred embodiment of this invention. The sixth preferred embodiment is similar to the third preferred embodiment except that the multimode ionization device 3 in the sixth preferred embodiment further includes a desorption unit 23 of the fifth preferred embodiment.

It should be noted that although in the above preferred embodiments, the electrospray plume is formed by virtue of a potential difference generated by a voltage supplying member 41, the electrospray plum can be generated by any known spray technique, such as those used in sonic spray devices, thermospray devices, AC voltage electrospray ionization devices, ionspray devices, etc.

Figure 10:
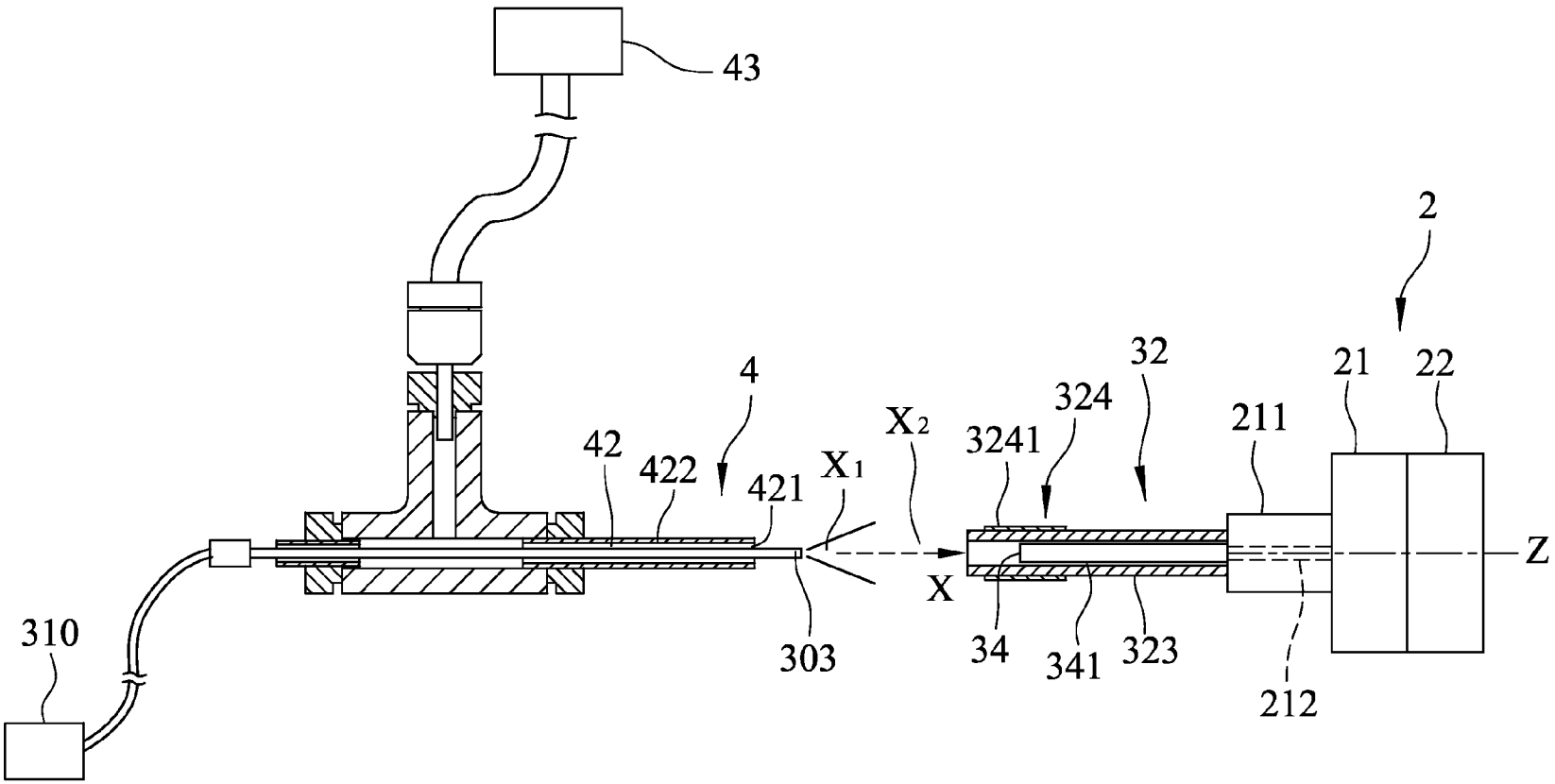
FIG. 10 is a fragmentary cross-sectional view of a multimode ionization device according to the seventh preferred embodiment of this invention.

For example, FIG. 10 illustrates a multimode ionization device 3 according to the seventh preferred embodiment of this invention. In the seventh preferred embodiment, the charge generating unit 4 is a sonic spray ionization device which includes an ion generating chamber 42 and a source of high velocity gas 43. The ion generating chamber 42 has an outlet disposed upstream of the nozzle 303, and an inner surface 422 having a material. The source of high velocity gas 43 is disposed to fluidly communicate with the inner surface 422 to permit a physical interaction between the high velocity gas and the material to produce the charges for the liquid electrospray medium to be ladened therewith.

In the following description of certain non-limiting examples, a protonated ion (MH+) refers to a molecule of the analyte with a proton attached thereto, a radical ($M.^+$) refers to a molecule of the analyte with an electron escaped therefrom, and a protonated ion $(M+2H)^{2+}$ or $(M+3H)^{3+}$ refers to a molecule of the analyte with two or three protons attached thereto.

Figure 11A:
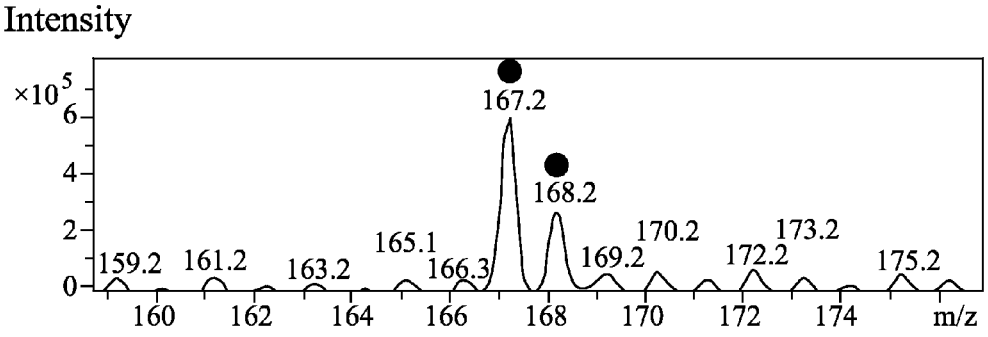
FIG. 11(*a*) shows a spectrum of a first sample which is taken using the multimode ionization device of FIG. 9 with both the electrospray ionization source (ESI source) and the atmospheric pressure chemical ionization source (APCI-plasma source) being operated.
Figure 11B:
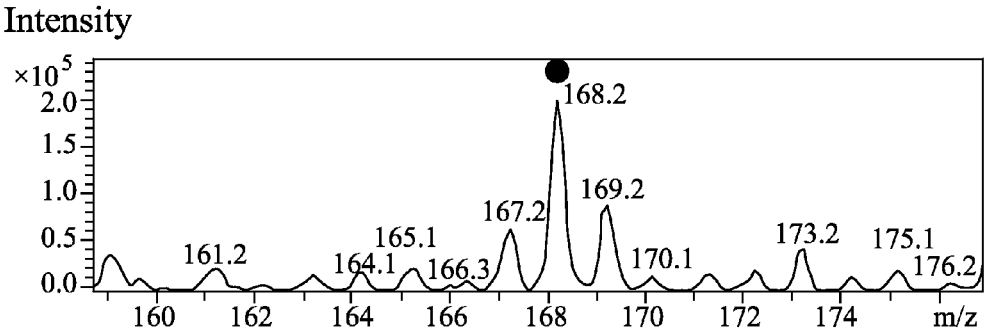
Figure 11C:
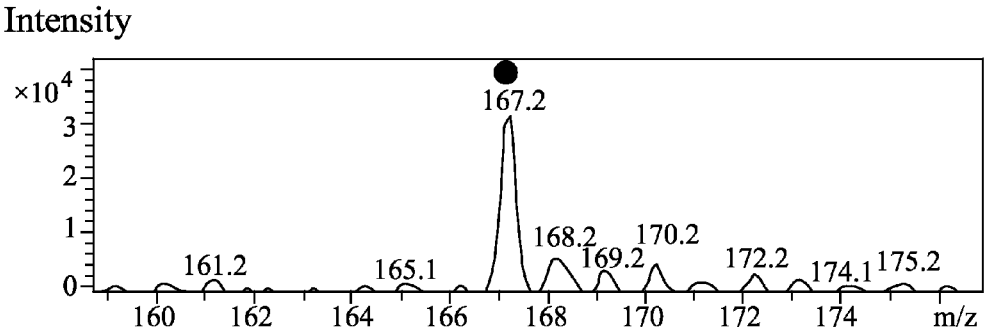

FIG. 11(*a*) shows an example spectrum of a first sample containing carbazole. The spectrum was obtained using the multimode ionization device 3 of FIG. 9, in which the desorption unit 23 is a laser desorption device. In this example, both the electrospray unit (ESI source) 31 and the plasma supplying unit (APCI source) 32 were operated. Signals for protonated ions ($MH^+$, m/z=168.2) and radicals ($M.^+$, m/z=167.2) of the carbazole were observed. As shown in FIG. 11(*b*), when only the electrospray unit 31 (ESI source) was operated, only the signal for the protonated ions ($MH^+$) of the carbazole was observed. As shown in FIG. 11(*c*), when only the plasma supplying unit 32 (APCI source) was operated, only the signal for the radicals ($M.^+$) of the carbazole was observed.

Figure 12A:
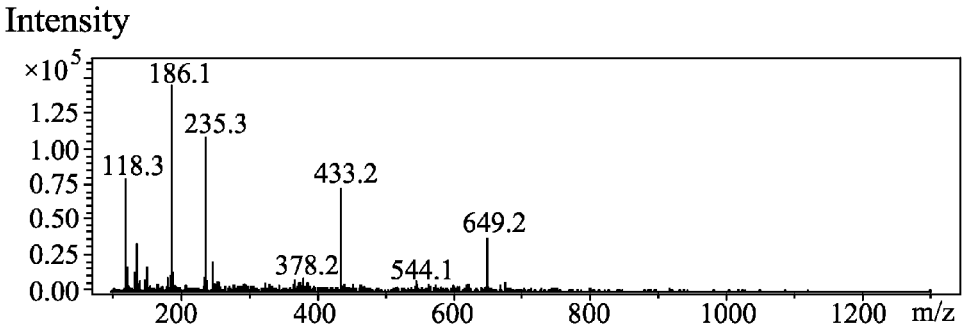
FIG. 12(*a*) shows a spectrum of a second sample which is taken using the multimode ionization device of FIG. 9 with both the ESI source and the APCI-plasma source being operated.
Figure 12B:
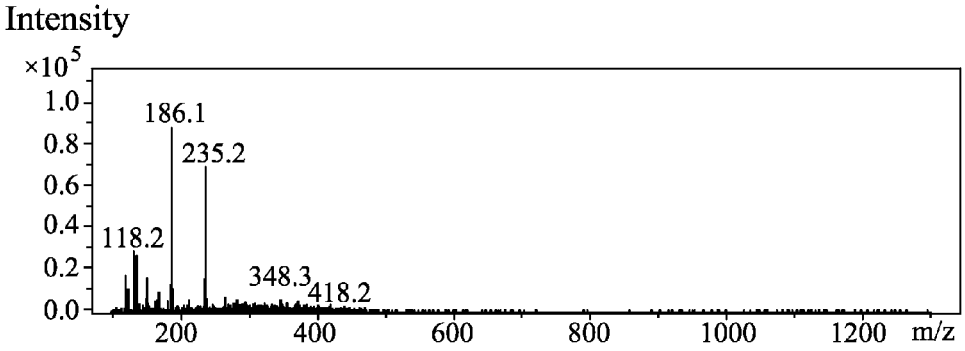
Figure 12C:
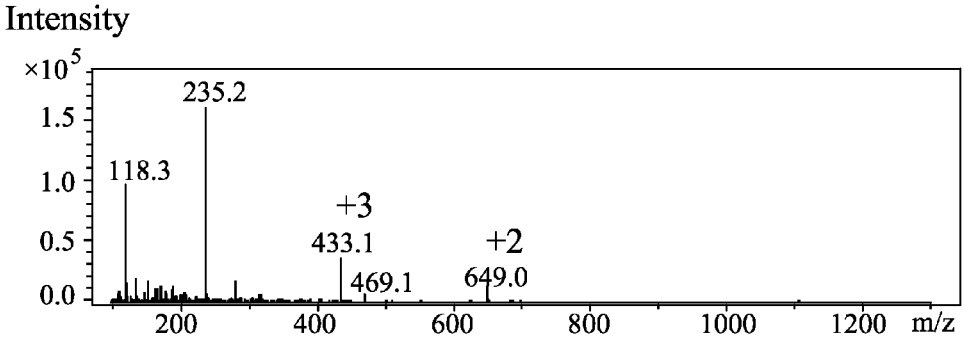

FIG. 12(*a*) shows an example spectrum of a second sample containing indole, ferrocene, lidocaine and Angiotensin I, and the spectrum was obtained using the multimode ionization device of FIG. 9, in which the desorption unit 23 is a laser desorption device. In this example, both the electrospray unit (ESI source) 31 and the plasma supplying unit (APCI source) 32 were operated. Signals for protonated ions ($MH^+$) of the indole (m/z=118.3), protonated ions ($MH^+$) of the lidocaine (m/z=235.3), radicals ($M.^+$) of ferrocene (m/z=186.1), protonated ions $(M+3H)^{3+}$ of Angiotensin I (m/z=433.2), and protonated ions $(M+2H)^{2+}$ of Angiotensin I (m/z=649.2) were observed.

Referring to FIG. 12(*b*), when only the plasma supplying unit 32 (APCI source) was operated, only the signals for indole (m/z=118.2), ferrocene (m/z=186.1), and lidocaine (235.2) were observed. Referring to FIG. 12(*c*), when only the electrospray unit 31 (ESI source) was operated, only the signals for indole (m/z=118.3), lidocaine (m/z=235.2) and Angiotensin I (m/z=433.1, 649.0) were observed.

It is evident from the above that when both the electrospray unit (ESI source) 31 and the plasma supplying unit (APCI source) 32 are used, the two different ionization sources can be used to ionize the analytes at the same time.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A multimode ionization device adapted for a mass spectrometer which includes a receiving unit disposed to admit therein ionized analytes that are derived from a sample, and that are to be analyzed by the mass spectrometer, said multimode ionization device comprising:

an electrospray unit including a reservoir for providing a liquid electrospray medium, and a nozzle which is disposed downstream of said reservoir and which is configured to form an electrospray plume of the liquid electrospray medium thereat, said nozzle being disposed to be spaced apart from the receiving unit so as to define a traveling path therebetween;

a charge generating unit configured to laden the liquid electrospray medium with a plurality of charges when the liquid electrospray medium runs up to said nozzle, thereby permitting the liquid electrospray medium to leave said nozzle as the electrospray plume for heading toward the receiving unit to be admitted thereinto; and a plasma supplying unit configured to generate and guide a plasma plume to mix with the electrospray plume so as to form a plume combination in a confluent zone which is upstream of a linearly-extending end zone of the traveling path, and which is oriented to permit at least one of analytes carried in the plume combination to travel to the receiving unit along the linearly-extending end zone, such that as a result of approaching the receiving unit along the linearly-extending end zone, charges of the plume combination will pass on to said at least one of the analytes carried in the plume combination to thereby form a corresponding one of the ionized analytes, wherein said charge generating unit includes an ion generating chamber having an outlet disposed upstream of said nozzle, and an inner surface having a material, and a source of high velocity gas disposed to fluidly communicate with said inner surface to permit a physical interaction between the high velocity gas and said material to produce the charges for the liquid electrospray medium to be ladened therewith.

* * * * *